US007424878B2

(12) United States Patent
Sugiyama

(10) Patent No.: US 7,424,878 B2
(45) Date of Patent: Sep. 16, 2008

(54) INTAKE PORT FOR 4-CYCLE ENGINE

(75) Inventor: Masaki Sugiyama, Shizuoka-ken (JP)

(73) Assignee: Fuji Robin Kabushiki Kaisha, Numazu-shi (JP)

( * ) Notice: Subject to any disclaimer, the term of this patent is extended or adjusted under 35 U.S.C. 154(b) by 0 days.

(21) Appl. No.: 11/511,364

(22) Filed: Aug. 29, 2006

(65) Prior Publication Data

US 2007/0169738 A1 Jul. 26, 2007

(30) Foreign Application Priority Data

Jan. 20, 2006 (JP) ..... 2006-12875

(51) Int. Cl.
*F02F 1/42* (2006.01)
*F02M 35/10* (2006.01)

(52) U.S. Cl. ..... 123/193.5; 123/184.21

(58) Field of Classification Search ..... 123/193.5, 123/184.21, 184.23, 193.6, 657, 659
See application file for complete search history.

(56) References Cited

U.S. PATENT DOCUMENTS 3,422,805 A * 1/1969 Dzianott ..... 123/188.14
4,166,436 A * 9/1979 Yamakawa ..... 123/262
6,026,774 A * 2/2000 Kajihara et al. ..... 123/184.21
6,460,502 B2 * 10/2002 Gracyalny ..... 123/193.5
6,668,783 B2 * 12/2003 Taylor ..... 123/193.5
2002/0117143 A1 * 8/2002 Gracyalny ..... 123/193.5
2004/0099238 A1 * 5/2004 Gould ..... 123/193.5

FOREIGN PATENT DOCUMENTS

JP 52-66105 6/1977
JP 9-170417 6/1997
JP 2000-136762 5/2000

* cited by examiner

*Primary Examiner*—M. McMahon
(74) *Attorney, Agent, or Firm*—McGinn IP Law Group, PLLC

(57) ABSTRACT

An intake port for a 4-cycle engine includes an intake port base integrally formed with a cylinder head, and an intake port forming member that forms an intake port together with the intake port base. The area of the cross section of the intake port orthogonal to a centerline of the intake port is substantially uniform from an open intake side thereof toward a combustion chamber. The angle made by the centerline of the intake port and an intake valve shaft is larger than 90° from a viewpoint of the intake valve. Thereby, the 4-cycle engine can output high power with the intake port shape, as formed with above mentioned configuration, that reduces intake resistance and that uses simple design molds. More specifically, the engine can reliably prevent condensed fuel from remaining in the intake port to avoid incomplete combustion of gas.

15 Claims, 4 Drawing Sheets

A-A

INTAKE PORT FOR 4-CYCLE ENGINE

BACKGROUND OF THE INVENTION

The present invention relates to a small 4-cycle engine used for driving a portable machine or the like, and more particularly to an intake port thereof.

The present application claims priority from Japanese Patent Application No. 2006-012875, the disclosure of which is incorporated herein by reference.

Small 4-cycle engines used for driving portable machines such as handheld blowers usually have their intake port integrally formed with the cylinder head because of the priority given to reduction of size and weight of the machine including the engine. Also, the cylinder head needs to be designed so that it is easily molded without using complex shape molds for lower cost.

More specifically, the intake port is conventionally designed to be formed so that its centerline on the entrance side is vertical to the centerline of the cylinder, while the centerline on the exit side is parallel to the cylinder centerline, i.e., the centerlines of the entrance side and the exit side of the intake port are substantially at right angles with each other. This shape allows easy fabrication of cylinder heads by die casting, contributing to reduction in cost of 4-cycle engines (see, for example, Japanese Unexamined Patent Publication No. Hei 9-170417, FIG. 5).

In general, the intake port shape should ideally be straight from the entrance to the exit so as to reduce intake resistance of fuel-air mixture. Japanese Unexamined Patent Publication No. Sho 52-66105, for example, shows a 4-cycle engine design in which the intake port shape is gently curved from the entrance to the exit.

Another known issue associated with the intake port is that condensed fuel tends to remain in the joint between the intake port and a heat insulator inserted between the carburetor for mixing liquid fuel with air and the intake port, causing possible incomplete combustion or generation of unburnt gas. One of countermeasures for this problem is disclosed, for example, in Japanese Unexamined Patent Publication No. 2000-136762, in which a conduit is provided in a protruded part of the heat insulator that is fitted with the intake port, the conduit communicating with the lower inner surface of the intake port, so as to prevent any condensed fuel from remaining inside the intake port.

The problem with the 4-cycle engine shown in Japanese Unexamined Patent Publication No. Hei 9-170417 is that the engine power output is not satisfactory due to large intake resistance of fuel-air mixture because the priority is given to reduction in size, weight, and cost of the engine and the intake port shape design still leaves scope for improvement. When used as the power source of a portable machine, the insufficient power of the engine has caused various problems in the operation of the machine.

The intake port shape of the 4-cycle engine shown in Japanese Unexamined Patent Publication No. Sho 52-66105 is hardly applicable to small engines mounted on portable machines because molding such intake port integrated with the cylinder head that entails the use of the complex and expensive metal molds, such as diagonally oriented slide molds, cores and the molding using sand molds, or the like, results in an increase in production cost and a decrease in productivity.

The problem with the 4-cycle engine shown in Japanese Unexamined Patent Publication No. 2000-136762 is that the effect of preventing condensed fuel from remaining inside the intake port is not sufficiently achieved when design changes are made to the shape of the intake port.

SUMMARY OF THE INVENTION

The present invention was devised in view of the above problems in the conventional techniques and its object is to provide a 4-cycle engine easily capable of outputting high power with an intake port shape that reduces intake resistance and that can be formed without increasing the number of members as compared to conventional engines. Another object of the invention is to provide a small 4-cycle engine that can reliably prevent condensed fuel from remaining in the intake port to avoid incomplete combustion of gas or generation of unburnt gas.

To achieve the above object, a first aspect of the present invention provides an intake port of a 4-cycle engine including an intake port base integrally formed with a cylinder head, and an intake port forming member that is partly fitted into the intake port base and forms the intake port together with the intake port base. The shape of intake port has an area of a cross section orthogonal to a centerline of the intake port that is substantially uniform from an open intake side to a part communicated with a combustion chamber, and an angle made by the centerline of the intake port and an intake valve shaft that is larger than 90° from a viewpoint of an intake valve.

According to a second aspect of the invention, in the intake port of the 4-cycle engine with the above configuration of the first aspect, the circumference where a plane orthogonal to the centerline of the intake port intersects the intake port is, partly or entirely, made up of two members which are the intake port base and the intake port forming member.

Furthermore, according to a third aspect, in the intake port of the 4-cycle engine with the above configuration of the first aspect, the angle made by the centerline of the intake port and the intake valve shaft from a viewpoint of the intake valve becomes gradually larger toward the intake valve.

According to a fourth aspect, in the intake port of the 4-cycle engine with the above configuration of the first aspect, the intake port forming member is a synthetic resin heat insulator.

According to a fifth aspect, in the intake port of the 4-cycle engine with the above configuration of the first aspect, a joint between the intake port base and the intake port forming member where they together form the intake port is substantially parallel to the centerline of the intake port.

Furthermore, according to a sixth aspect, in the intake port of the 4-cycle engine with the above configuration of the first aspect, a groove is provided in an inner surface of the intake port base that extends from the joint between the intake port base and the intake port forming member toward the intake valve.

The intake port of the 4-cycle engine in accordance with the first aspect of the present invention includes the intake port base integrally formed with the cylinder head, and the intake port forming member that is partly fitted into the intake port base and forms an intake port together with the intake port base. The area of the cross section orthogonal to the centerline of the intake port is substantially uniform from the open intake side to the part communicated with the combustion chamber. The angle between the centerline of the intake port and the intake valve shaft is larger than 90° from a viewpoint of the intake valve.

As the effect of the first aspect, this intake port design allows smooth flow of fuel-air mixture with low intake resistance, and the cylinder head easily made by die casting or the like without using complex shape metal molds, resulting in a small, light, low-cost, and powerful 4-cycle engine.

In the second aspect, in addition to the effect of the first aspect, the circumference where the plane orthogonal to the centerline of the intake port intersects the intake port is, partly or entirely, made up of two members, i.e., the intake port base and the intake port forming member. By using such combined members, the cylinder head can be easily made using simple shape metal molds, resulting in the 4-cycle engine with the reduced size, weight, and cost.

In the third aspect, in addition to the effect of the first aspect, the angle made by the centerline of the intake port and the intake valve shaft from a viewpoint of the intake valve becomes gradually larger toward the intake valve, which assures the intake port with the lower intake resistance and smoother flow of the fuel-air mixture therein.

In the fourth aspect, in addition to the effect of the first aspect, the intake port forming member comprising a synthetic resin heat insulator allows an ideal intake port shape to cause smooth flow of fuel-air mixture without increasing the number of members as compared to conventional engines. Furthermore, the sealing properties of the intake port can be enhanced because the heat insulator is made of a soft synthetic resin.

In the fifth aspect, in addition to the effect of the first aspect, the joint between the intake port base and the intake port forming member where they together form the intake port is substantially parallel to the centerline of the intake port. This design allows any condensed fuel that has entered the joint to flow down to the combustion chamber below the intake valve and prevents any condensed fuel from remaining inside the intake port. Thereby, this 4-cycle engine capable of preventing incomplete combustion of gas or generation of unburnt gas can be provided.

Furthermore, in the sixth aspect, in addition to the effect of the fifth aspect, a groove is provided in the inner surface of the intake port base that extends from the joint toward the intake valve. Thus, any condensed fuel can be effectively prevented from remaining inside the intake port.

BRIEF DESCRIPTION OF THE DRAWINGS

These and other objects and advantages of the present invention will become clear from the following description with reference to the accompanying drawings, wherein.

DETAILED DESCRIPTION OF PREFERRED EMBODIMENTS

Figure 1:
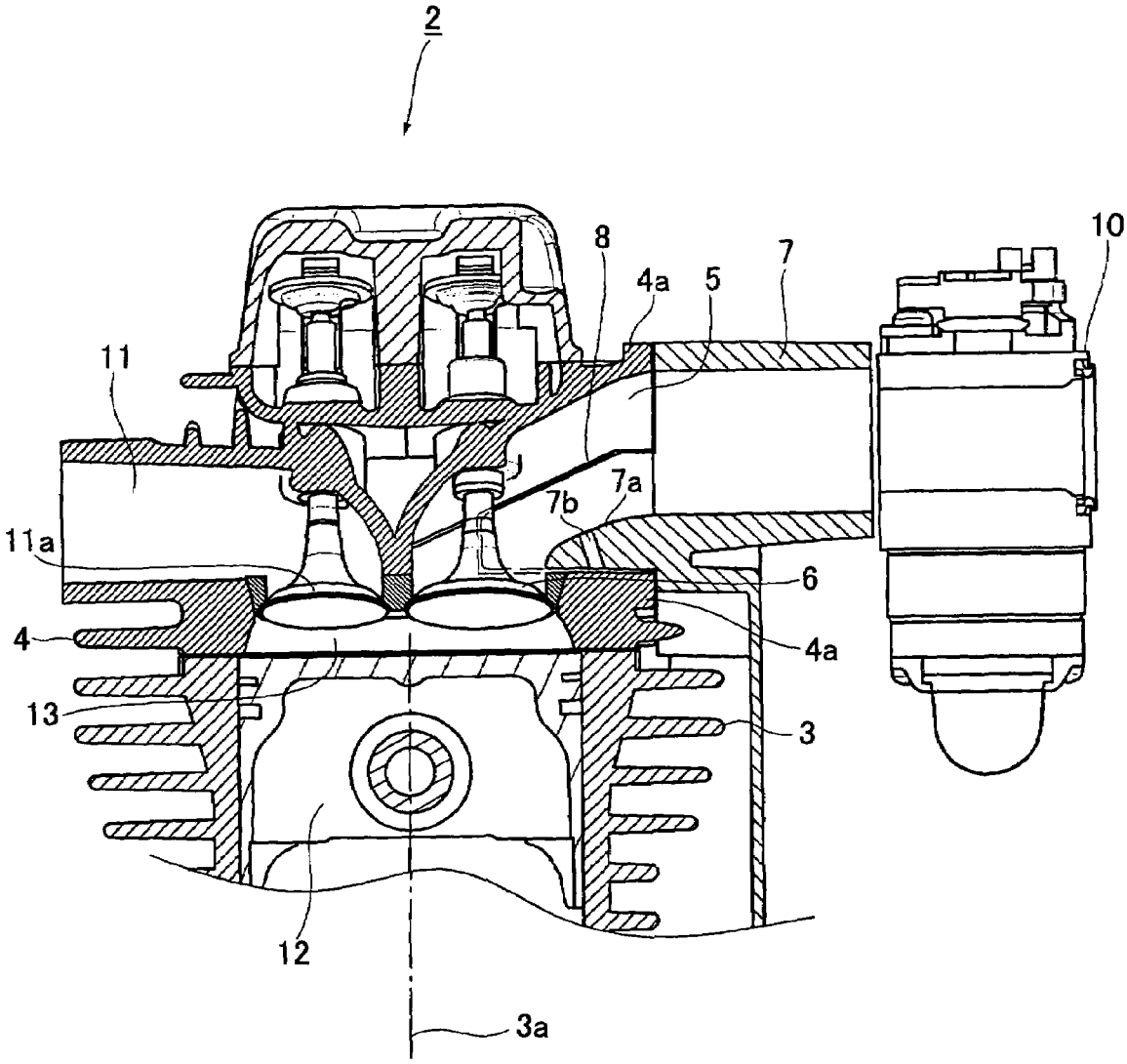
FIG. 1 is a cross sectional view illustrating relevant parts of a 4-cycle engine according to one embodiment of the present invention.
Figure 2A:
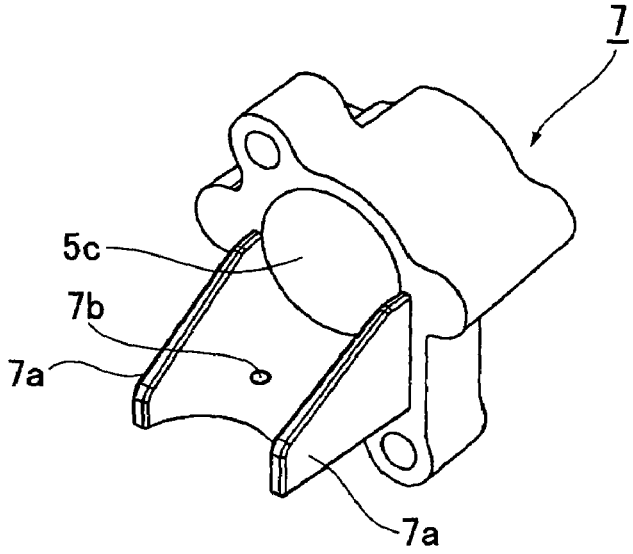
FIG. 2A is a perspective view and FIG. 2B is a front view of a heat insulator used in the embodiment of the invention.
Figure 2B:
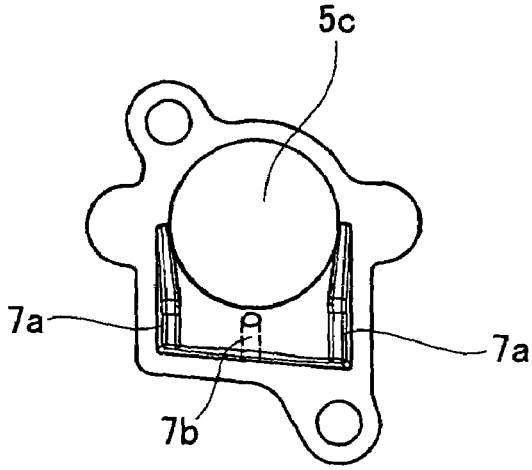
Figure 3:
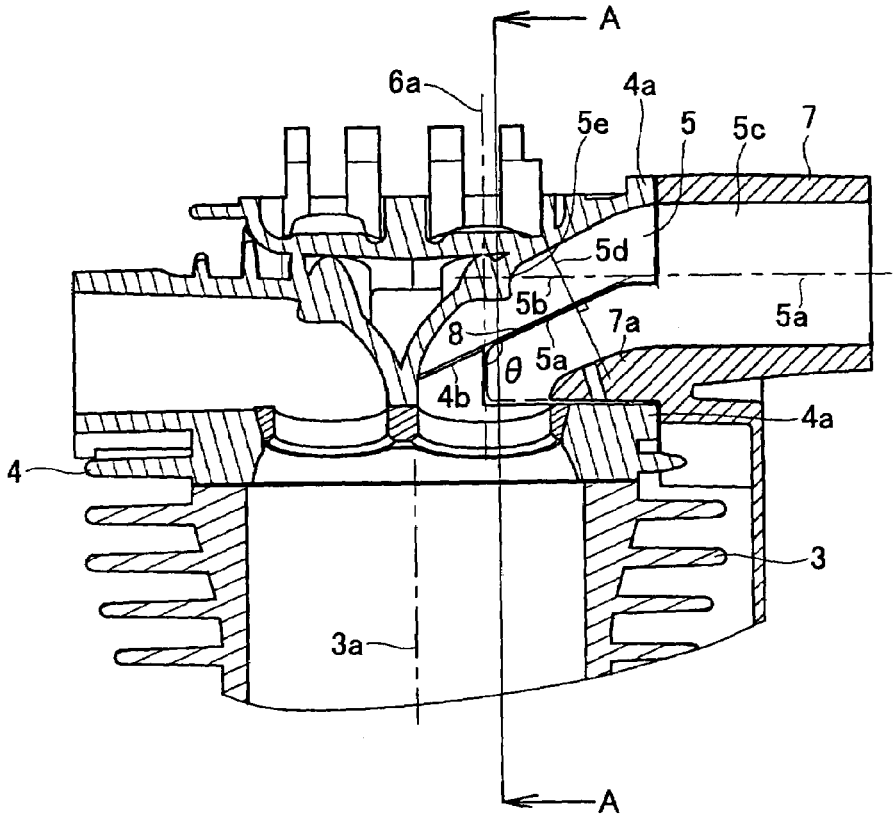
FIG. 3 is a cross sectional view illustrating relevant parts of the 4-cycle engine in accordance with the embodiment of the present invention.
Figure 4:
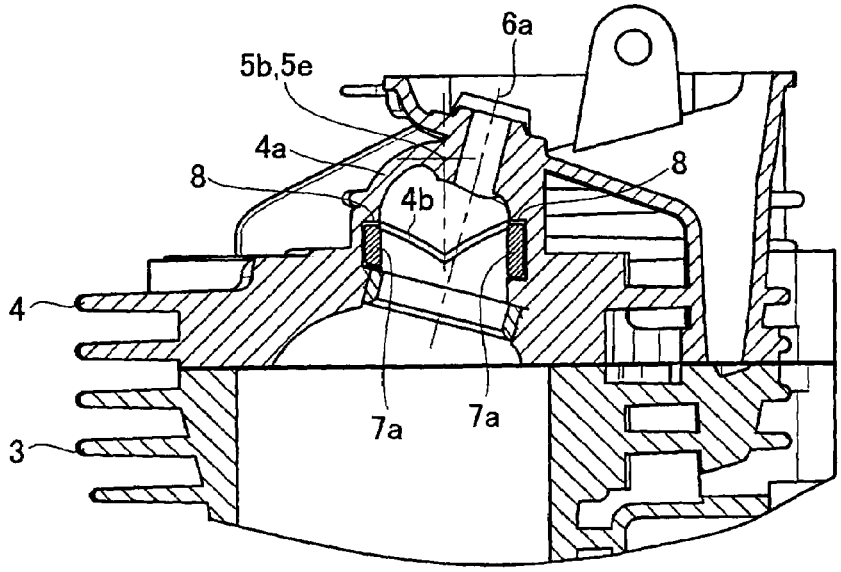
FIG. 4 is a cross sectional view taken along the line A-A of FIG. 3.
Figure 5:
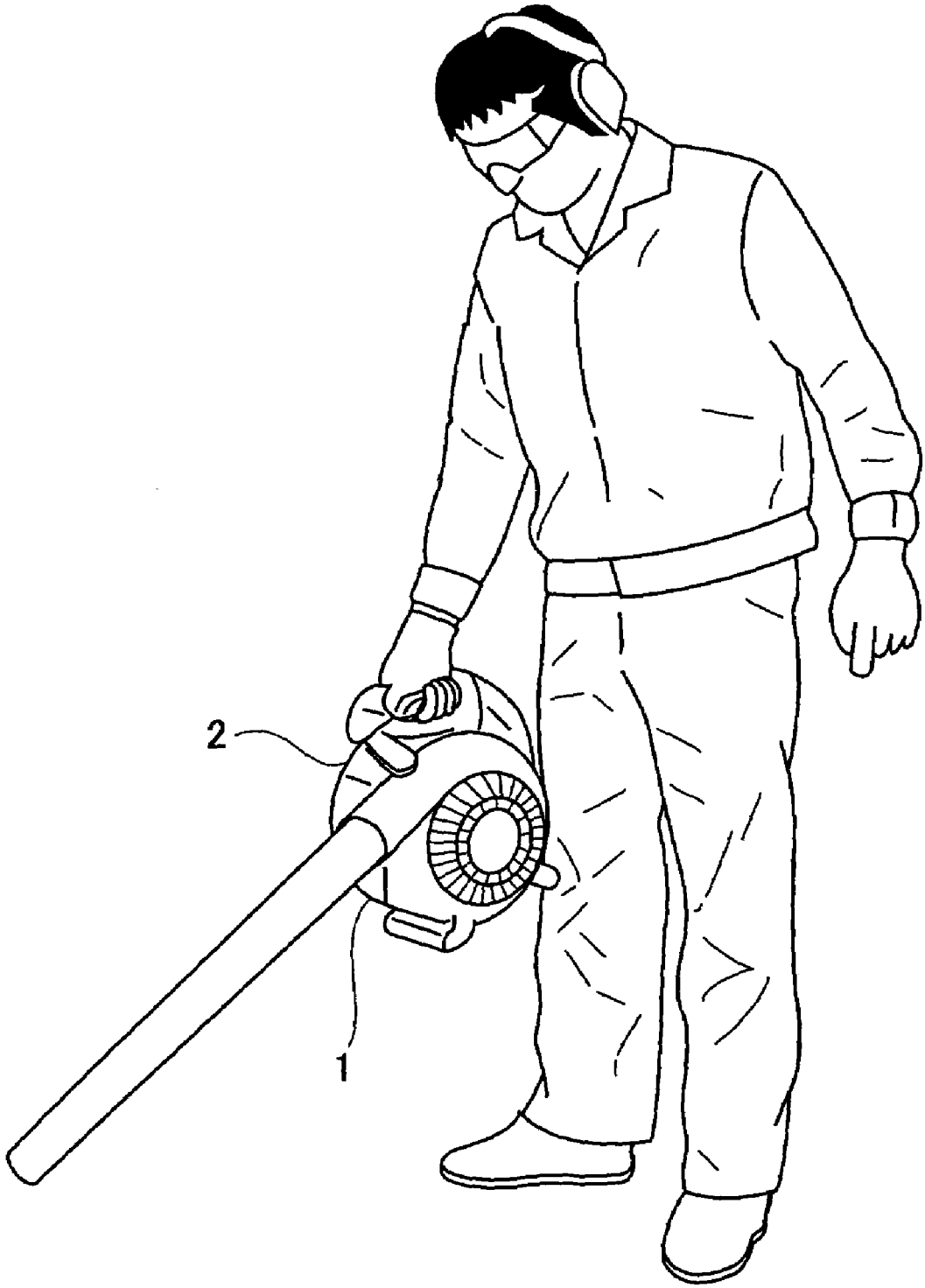
FIG. 5 illustrates one example of use of the 4-cycle engine in accordance with the embodiment of the invention.

One preferred embodiment of the 4-cycle engine of the present invention will be hereinafter described with reference to the drawings. FIG. 1 is a cross sectional view illustrating relevant parts of the 4-cycle engine according to one embodiment of the present invention; FIG. 2A is a perspective view and FIG. 2B is a front view of a heat insulator used in the embodiment of the invention; FIG. 3 is a cross sectional view illustrating relevant parts of the cylinder head of the 4-cycle engine in accordance with the embodiment of the present invention; FIG. 4 is a cross sectional view taken along the line A-A of FIG. 3; and FIG. 5 illustrates one example of use of the 4-cycle engine in accordance with the embodiment of the invention.

As shown in FIG. 1, a cylinder head 4 is placed on a top of a cylinder 3 and firmly tightened to the cylinder 3 with bolts or the like. Both of the cylinder 3 and the cylinder head 4 are aluminum alloy die castings. The 4-cycle engine 2 in accordance with the present embodiment has a configuration in which the cylinder head 4 is separable from the cylinder 3, and an exhaust port 11 and an intake port base 4*a* that forms an intake port 5 are integrally formed with the cylinder head 4. To the open end of the intake port base 4*a* is fitted a heat insulator 7, which serves as an intake port forming member, to form the intake port 5 together with the intake port base 4*a*. To the other end of the heat insulator 7 is connected a carburetor 10.

For such 4-cycle engine 2, fuel such as gasoline supplied from a fuel tank (not shown) is mixed with air in the carburetor 10 and fed to the combustion chamber 13 through the intake port 5. The intake valve 6 opens and the fuel-air mixture is fed into the combustion chamber 13, where the 4-stroke cycles, intake stroke, compression stroke, combustion stroke, and exhaust stroke, are repeated. The exhaust valve 11*a* opens in the exhaust stroke to let out exhaust gas from the combustion chamber 13 through the exhaust port 11 to the muffler (not shown), through which the gas is discharged to the outside. Reference numeral 8 in FIG. 1 denotes the joint between the intake port base 4*a* of the cylinder head 4 and a protruded part 7*a* of the heat insulator 7, reference numeral 3*a* denotes the centerline of the cylinder 3, and reference numeral 12 denotes the piston that reciprocates up and down inside the cylinder 3.

FIG. 2A and FIG. 2B illustrate one example of the heat insulator 7 used in the 4-cycle engine 2 in accordance with the present embodiment. FIG. 2A is a perspective view of the heat insulator 7, and FIG. 2B is a front view from the side of the protruded part 7*a* of the heat insulator 7. The heat insulator 7 that is formed by molding a heat insulating synthetic resin and inserted between the intake port base 4*a* of the cylinder head 4 and the carburetor 10 for mixing liquid fuel such as gasoline with air has the functions such that heat from the cylinder head 4 is not easily conducted to the carburetor 10 and that the intake port 5 is well sealed. The heat insulator 7 includes a cylindrical through hole 5*c* through which the fuel-air mixture flows, and the protruded part 7*a* that is fitted into the intake port base 4*a* of the cylinder head 4 to form part of the intake port 5. The protruded part 7*a* that is wider than the inner circumference of the through hole 5*c*, and has the flat-shaped outsides and substantially arch-shaped inner circumference in section as shown in FIG. 2B, forms part of the intake port 5. With this shape, the base portion of the protruded part 7*a* can be made thick so as to enhance the rigidity of the heat insulator 7. A hole denoted by reference numeral 7*b* communicating the inner surface of the protruded part 7*a* (which is part of the intake port 5) with the intake port base 4*a* of the cylinder head 4 is provided for effectively preventing condensed fuel that has entered between the protruded part 7*a* and the intake port base 4*a* from remaining therein.

FIG. 3 is a cross sectional view illustrating a state in which the heat insulator 7 is fitted into the intake port base 4*a* of the cylinder head 4. As can be seen, the shape of the intake port 5, formed by the intake port base 4*a* and the heat insulator 7 serving as an intake port forming member is such that the area of the cross section orthogonal to the centerline 5*a* of the intake port 5 is substantially uniform from the open intake side where the heat insulator 7 is fitted into the part that communicates with the combustion chamber 13, the angle θ made by the centerline 5*a* of the intake port 5 and the intake valve shaft 6*a* is larger than 90° from a viewpoint of the intake valve 6, and the circumference 5*d* where the plane orthogonal to the centerline 5*a* of the intake port 5 that intersects the intake port 5 is made up of two members, i.e., the intake port base 4*a* and the heat insulator (see FIG. 1). With the intake port 5 formed by such combined member, the molding of the intake port base 4*a* does not need any complex metal molds, therefore a cost reduction of the cylinder head 4 can be achieved, and in addition, a gently curved intake port design is made possible, which reduces intake resistance of fuel-air mixture.

In the present embodiment, the top face of the intake port base 4*a* which forms part of the intake port 5 and the inner surface of the protruded part 7*a* of the heat insulator 7 are gently curved from the open intake side toward the combustion chamber, so that the angle θ made by the centerline 5*a* of the intake port 5 and the intake valve shaft 6*a* becomes larger toward the intake valve 6. This design enables to form the intake port 5 with lower gentle flow of the fuel-air mixture inside the intake port 5. The smooth curve of the inner surface of the heat insulator 7, in particular, makes occurrence of turbulence in the fuel-air mixture less likely.

The joint 8 between the intake port base 4*a* and the protruded part 7*a* of the heat insulator 7 where they form the intake port 5 is substantially parallel to the centerline 5*a* of the intake port 5. Therefore, the joint 8 inclines downward toward the combustion chamber 13. This configuration allows any condensed fuel inside the intake port 5 that has entered the joint 8 to constantly flow down to the combustion chamber 13, such condensed fuel to be prevented from remaining inside the intake port 5, and incomplete combustion of gas or generation of unburnt gas to be prevented.

Furthermore, grooves 4*b* may be provided in the intake port 5, extending toward the intake valve 6 from the joints 8 to the intake port base 4*a*.

FIG. 4 is a cross sectional view taken along the line A-A of FIG. 3. As shown in FIG. 3 and FIG. 4, the two grooves 4*b* that extend from the two joints 8 meet at the point lower than the intersection 5*e* between the intake port base 4*a* and an extension line 5*b* that extends straight toward the intake port base 4*a* from the centerline 5*a* of the through hole 5*c* of the heat insulator 7 near the carburetor 10. With the grooves 4*b* being thus formed, any condensed fuel stuck to the inner surface of the intake port 5 that has entered the joints 8 flows down the joints 8 with the intake current, travels along the grooves 4*b* down to the intersection, and falls down to the combustion chamber 13 below. Thus, such condensed fuel is prevented from remaining inside the intake port 5. With the combination of the metal cylinder head 4 and synthetic resin heat insulator 7 which have different thermal expansion coefficients, it is possible to design various members such that gaps at the joints 8 expand as the temperature rises during driving the engine 2 and are connected smoothly to the grooves 4*b* in the same width. Thereby, the grooves 4*b* can effectively perform the enhanced function as oil guide grooves for preventing any condensed fuel from remaining therein.

FIG. 5 illustrates one example of use of the 4-cycle engine in accordance with the present embodiment. The engine 2 is used as the power source of a portable machine such as a handheld blower 1 which is used, for example, for cleaning such as clearing away leaves.

While the 4-cycle engine 2 has been described as having a separable cylinder head 4 and cylinder 3 in the present embodiment, the present invention can also be applicable to engines with a one-piece cylinder and cylinder head assembly.

As described above, the present invention can provide a 4-cycle engine easily capable of outputting high power using an intake port shape with lower intake resistance that can be formed without increasing the number of members and with good productivity. The invention can also provide a small 4-cycle engine that can reliably prevent condensed fuel from remaining to avoid incomplete combustion of gas or generation of unburnt gas.

The 4-cycle engine of the present invention is applicable not only to handheld blowers but also to various portable machines such as chain saws, back pack blowers, and bush cutters, and can also be effectively available vehicles or the like.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. An intake port for a 4-cycle engine comprising:

an intake port base integrally formed with a cylinder head;

an intake port forming member that is partly fitted into the intake port base and forms the intake port together with the intake port; and a joint configured between the intake port base and the intake port forming member, wherein the intake port has a shape with an angle of larger than 90° made by a centerline of the intake port and an intake valve side of an intake valve shaft, and wherein one or more grooves extend from the joint toward the intake valve in an inner surface of the intake port base.

2. The intake port for the 4-cycle engine according to claim 1, wherein the angle made by the centerline of the intake port and the intake valve side of the intake valve shaft becomes gradually larger toward the intake valve.

3. The intake port for the 4-cycle engine according to claim 1, wherein the intake port forming member comprises a synthetic resin heat insulator.

4. The intake port for the 4-cycle engine according to claim 1, wherein the intake port further has a shape with an area of a cross section orthogonal to a centerline of the intake port that is substantially uniform from an open intake side to a part connected with a combustion chamber.

5. The intake port for the 4-cycle engine according to claim 1, wherein the joint comprises two parallel parts which are substantially parallel to the centerline of the intake port, and wherein the grooves extend from each of both the parallel parts.

6. The intake port for the 4-cycle engine according to claim 5, wherein said grooves are connected to each other at a point near the intake valve.

7. The intake port for the 4-cycle engine according to claim 3, wherein said synthetic resin heat insulator comprises a protruded part, wherein said joint is configured between said intake port base and said protruded part, and wherein said protruded part is partly fitted into the intake port base and forms the intake port together with the intake port base.

8. The intake port for the 4-cycle engine according to claim 7, wherein said protruded part is wider than an inner circumference of a through hole of said intake port forming member and includes a flat outer portion and an arched inner circumference.

9. The intake port for the 4-cycle engine according to claim 7, wherein said protruded part comprises a communicating hole for communicating with said intake port base such that condensed fuel is prevented from remaining between said protruded part and said intake port base.

10. The intake port for the 4-cycle engine according to claim 7, wherein a top face of the intake port base and an inner surface of said protruded part are curved from said intake valve side toward a combustion chamber.

11. The intake port for the 4-cycle engine according to claim 5, wherein said joint inclines toward a combustion chamber such that condensed fuel inside said joint of said intake port flows to said combustion chamber and is prevented from remaining inside said intake port.

12. A 4-cycle engine, comprising:

a cylinder comprising a cylinder head tightened to said cylinder;

an exhaust port integrally formed with said cylinder head, comprising an exhaust valve;

an intake port, comprising:

an intake port base integrally formed with said cylinder head;

an intake port forming member that is partly fitted into the intake port base and forms the intake port together with the intake port base; and a joint configured between the intake port base and the intake port forming member;

a carburetor for connecting to said intake port forming member and mixing fuel and air; and a combustion chamber for receiving a fuel and air mixture from said carburetor through said intake port, wherein the intake port has a shape with an angle of larger than 90° made by a centerline of the intake port and an intake valve side of an intake valve shaft, and wherein one or more grooves extend from the joint toward the intake valve in an inner surface of the intake port base.

13. The 4-cycle engine according to claim 12, wherein the intake port further has a shape with an area of a cross section orthogonal to a centerline of the intake port that is substantially uniform from an open intake side to a part connected with a combustion chamber.

14. The 4-cycle engine according to claim 12, wherein the joint comprises two parallel parts which are substantially parallel to the centerline of the intake port, and wherein the grooves extend from each of both the parallel parts.

15. The 4-cycle engine according to claim 14, wherein said grooves are connected to each other at a point near the intake valve.

* * * * *